US008020934B2

(12) United States Patent
Hu

(10) Patent No.: US 8,020,934 B2
(45) Date of Patent: Sep. 20, 2011

(54) CHAIR BACKREST ELEVATING DEVICE

(76) Inventor: Jung-Hua Hu, Antin Shiang (TW)

( * ) Notice: Subject to any disclaimer, the term of this patent is extended or adjusted under 35 U.S.C. 154(b) by 156 days.

(21) Appl. No.: 12/503,083

(22) Filed: Jul. 15, 2009

(65) Prior Publication Data

US 2011/0012412 A1 Jan. 20, 2011

(51) Int. Cl.
*A47C 7/40* (2006.01)

(52) U.S. Cl. ..... 297/353

(58) Field of Classification Search ..... 297/353; 248/407, 408, 157, 423
See application file for complete search history.

(56) References Cited

U.S. PATENT DOCUMENTS 4,749,230 A * 6/1988 Tornero ..... 297/353
5,951,107 A * 9/1999 Tornero ..... 297/353
6,299,253 B1 * 10/2001 Chen ..... 297/353
7,188,901 B2 * 3/2007 Helmond et al. ..... 297/353
7,360,837 B1 * 4/2008 Liu ..... 297/353
7,775,593 B2 * 8/2010 Hu ..... 297/353
2003/0057756 A1 * 3/2003 Lai ..... 297/353

* cited by examiner

*Primary Examiner* — Milton Nelson, Jr.

(57) ABSTRACT

A chair backrest elevating device includes a slide base having a slide way provided with a recessed hole and a positioning rod. An adjusting unit is combined with the positioning rod, composed of a sustaining member, a movable block, a spring, a positioning block and an elastic retainer. A fixing plate unit received in the slide way of the slide base contains a fitting block and a fixing plate. A slide cover is coupled with the slide base for covering the adjusting unit and the fixing plate unit. The slide base and the slide cover are assembled on a chair backrest while the fixing plate unit is combined with a seat. When the backrest is pulled up or down, the slide base and the slide cover is also shifted to have the sustaining member engaged in different-level engage grooves of the fitting block, thus adjusting the backrest upward or downward.

2 Claims, 8 Drawing Sheets

CHAIR BACKREST ELEVATING DEVICE

BACKGROUND OF THE INVENTION

1. Field of the Invention

This invention relates to a chair backrest elevating device, particularly to one having a slide base and a slide cover assembled on a chair backrest, and a fixing plate unit combined with a chair seat. Thus, when the chair backrest is pulled up or down, the slide base and the slide cover will be actuated to shift to enable the sustaining member of an adjusting unit, which is combined with the positioning rod of the slide base, to be correspondingly engaged and positioned in different-level engage grooves of an engage block, thus attaining effect of adjusting a chair backrest to move upward or downward.

2. Description of the Prior Art

Generally, the seat and the backrest of a conventional chair are fixed in form and impossible to be adjusted, while the backrest of another conventional chair is adjustable in elevation angles so that a user can lie on the backrest comfortably. However, the backrests of these two conventional chairs are respectively secured at the rear side of the seat and fixed in height; therefore, the backrest is impossible to be adjusted in height for matching with the height and the stature of a sitter in order to effectively support the back of the sitter.

SUMMARY OF THE INVENTION

The objective of this invention is to offer a chair backrest elevating device, able to adjust a chair backrest to move upward or downward conveniently and fix it in position steadily.

The chair backrest elevating device in the present invention includes a slide base having a slide way disposed with a recessed hole and a positioning rod with an opening, and the slide base has two opposite sides respectively bored with a plurality of insert holes. An adjusting unit to be combined with the positioning rod of the slide base is composed of a sustaining member, a movable block, a spring, a positioning block with an insert hole and an elastic retainer. The sustaining member is provided with two slot ways and a groove between the two slot ways, and the movable block and the positioning block are orderly received in one of the two slot ways, while the spring is positioned between the movable block and the positioning block to push them. The elastic retainer is positioned in the groove between the two slot ways, having one end forced in the insert hole of the positioning block and another end resisting against the inner wall of another slot way of the sustaining member. A fixing plate unit is to be combined with the slide way of the slide base, composed of a fitting block and a fixing plate. The fitting block is formed with an adjusting opening having one side disposed with a plurality of engage grooves, and one end formed with a stop wall and another end provided with a beveling surface, and further has two opposite sides respectively fixed with a plurality of bent bars respectively having a projecting edge. The fixing plate has an upright portion formed with a fitting opening and flat portion bored with plural insert holes. A slide cover is to be coupled with the slide base for covering the adjusting unit and the fixing plate unit, provided with plural projections respectively fitted thereon with a soft ring, bored with a positioning hole in the center and a plurality of insert holes in two opposite sides and having a threaded hole formed between every two insert holes.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
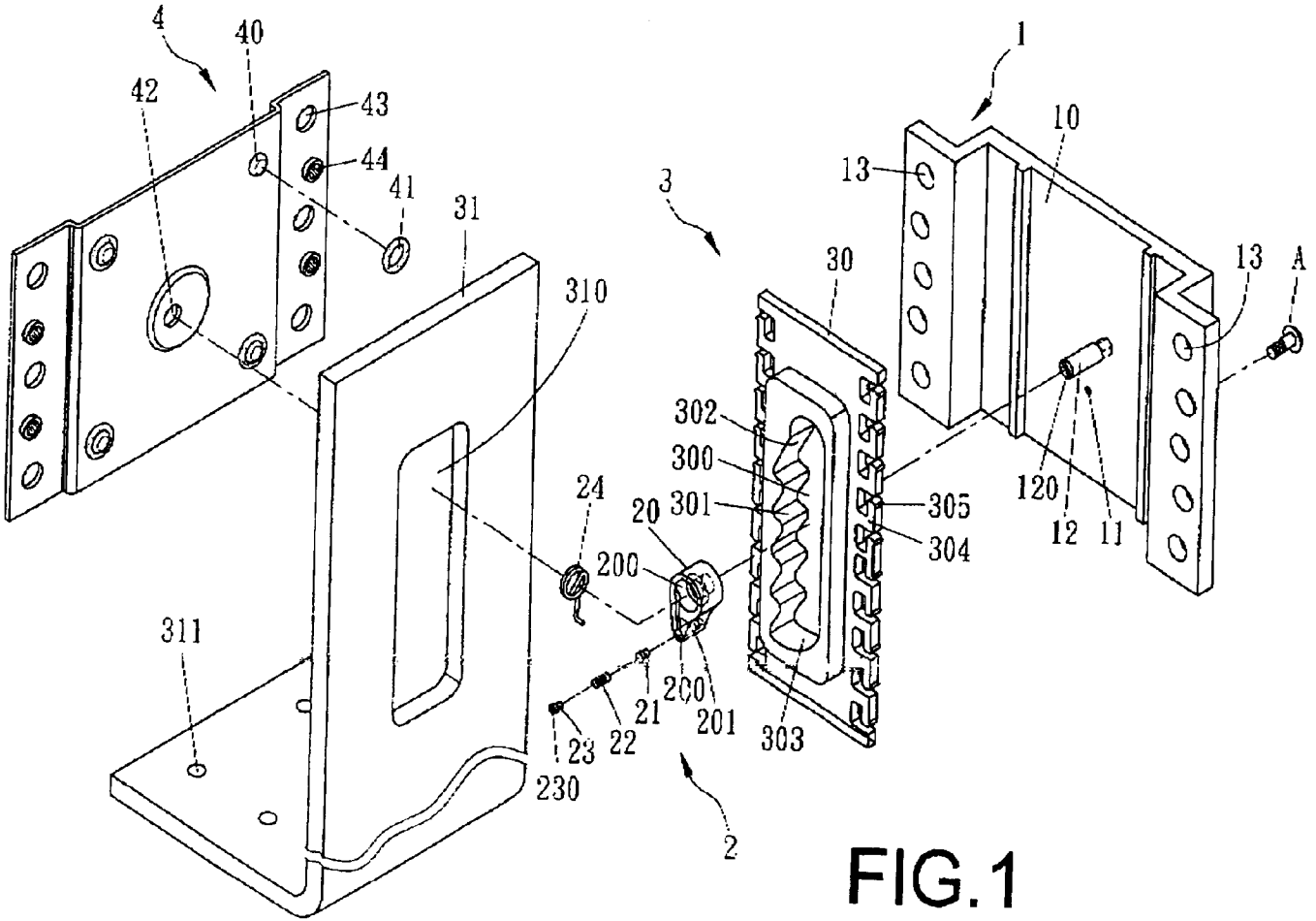
FIG. 1 is an exploded perspective view of a chair backrest elevating device in the present invention.
Figure 2:
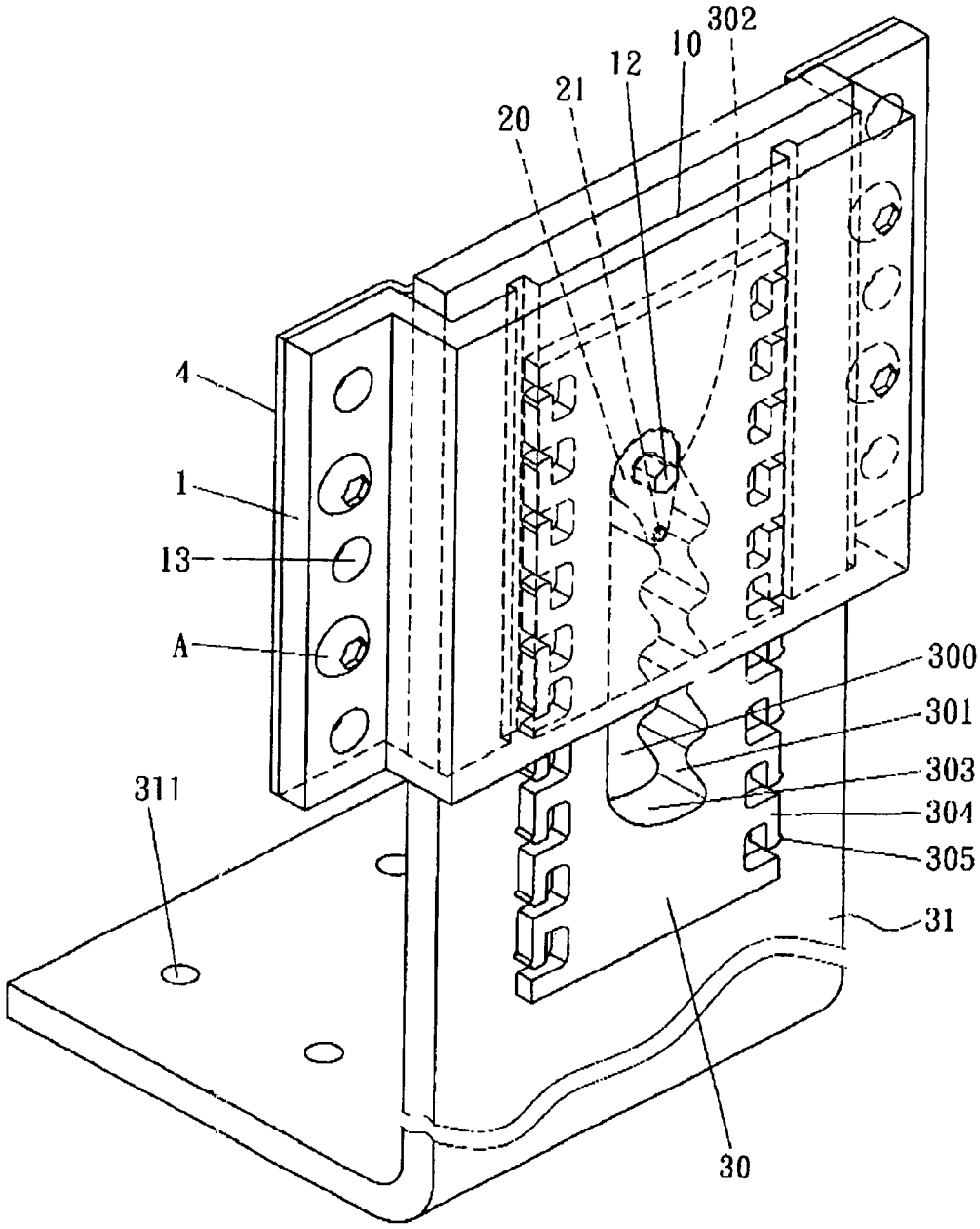
FIG. 2 is a rear perspective view of the chair backrest elevating device in the present invention.
Figure 3:
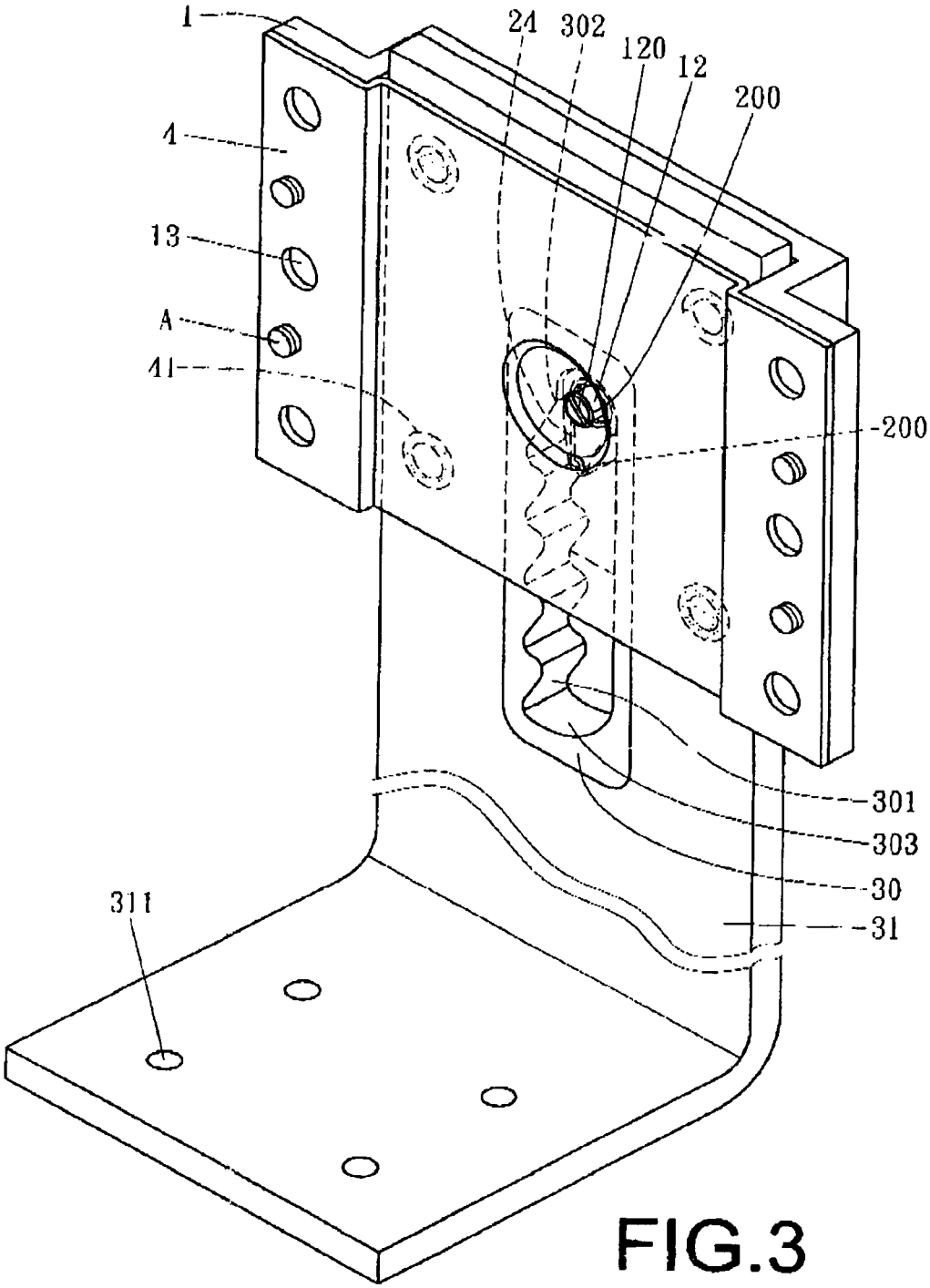
FIG. 3 is a front perspective view of the chair backrest elevating device in the present invention.

A preferred embodiment of a chair backrest elevating device in the present invention, as shown in FIG. 1, includes a slide base 1, an adjusting unit 2, a fixing plate unit 3 and a slide cover 4 as main components combined together.

The slide base 1 is formed with a slide way 10 provided with a recessed hole 11 and a positioning rod 12 bored with an opening 120, and having its lower portion formed into a polygon and its upper portion shaped as a round rod. The slide base 1 further has two opposite sides respectively provided with a plurality of insert holes 13.

The adjusting unit 2 to be combined with the positioning rod 12 of the slide base 1 is composed of a sustaining member 20, a movable block 21, a spring 22, a positioning block 23 and an elastic retainer 24. The sustaining member 20 is disposed with two slot ways 200 and a groove 201 between the two slot ways 200. The movable block 21 and the positioning block 23 are received in a first slot way 200, and the spring 22 is positioned between the movable block 21 and the positioning block 23 to push and prop them up, and further the positioning block 23 is bored with an insert hole 230. The elastic retainer 24 is positioned in the groove 201 between the two slot ways 200, having one end forced in the insert hole 230 of the positioning block 23 and another end resisting against the inner wall of a second slot way 200.

The fixing plate unit 3 is to be combined with the slide way 10 of the slide base 1, consisting of a fitting block 30 and a fixing plate 31 fitted together with the fitting block 30. The fitting block 30 is formed with an adjusting opening 300 having one side formed with a plurality of engage grooves 301 continually and vertically connected, and having one end provided with a stop wall 302 and another end disposed with a beveling surface 303 and further having two opposite edges respectively provided with lots of bent bars 304 respectively having a projecting edge 305. The fixing plate 31 has an upright portion bored with a fitting opening 310 and a flat portion bored with a plurality of insert holes 311.

The slide cover 4 is to be coupled with the slide base 1 for covering the adjusting unit 2 and the fixing plate unit 3, provided with a plurality of projections 40 respectively having a soft ring 41 fitted thereon. Further, the slide cover 4 is bored with a positioning hole 42 in the center and a plurality of insert holes 43 at two opposite sides, having a threaded hole 44 bored between every two insert holes 43.

In assembling, referring to FIGS. 1 to 4, firstly, the movable block 21 of the adjusting unit 2 and the spring 22 are orderly positioned in the first slot way 200 of the sustaining member 20, letting one end of the spring 22 push against the movable block 21 and another end resist against the positioning block 23 after the positioning block 23 is secured in the first recessed hole 200. Subsequently, the elastic retainer 24 is positioned in the groove 201 between the two slot ways 200, having one end forced in the insert hole 230 of the positioning block 23 and another end resisting against the inner wall of the second slot way 200, and then the second slot way 200 of the adjusting unit 2 is fitted on the positioning rod 12 to have the elastic retainer 24 received in the opening 120 of the positioning rod 12. After the fitting block 30 of the fixing plate unit 3 is fitted together with the fixing plate 31, the adjusting opening 300 of the fitting block 30 is fitted with the sustaining member 20, letting one end of the sustaining member 20 able to be elastically engaged with one of the engage grooves 301 of the fitting block 30. Lastly, the slide cover 4 is covered on the adjusting unit 2 and the fixing plate unit 3 and firmly combined with the slide base 1 by means of screw members (A) respectively inserted through the insert holes 13 of the slide base 1 and screwed with the threaded holes 44 of the slide cover 4 and at this time, the positioning rod 12 of the slide base 1 is correspondingly inserted in the positioning hole 42 of the slide cover 4. Thus, the fixing plate 31 can be assembled with the seat 50 of a chair 5, with the slide base 1 secured at the rear side of the chair backrest 51 by screw members (A) respectively screwed through the insert holes 13 of the slide base 1 and the insert holes 43 of the slide cover 4, finishing assembling the chair backrest elevating device on a chair.

In using, referring to FIGS. 1 and 4 to 6, to adjust the backrest 51 downward, regardless of the position of the backrest 51, firstly, the backrest 51 has to be pulled up to the highest position, and accordingly the slide base 1 and the slide cover 4 are also to be moved up to the highest position. During the moving process, the sustaining member 20 is moved upward and stopped by the stop wall 302 of the fitting block 30 to let the elastic retainer 24 shift elastically, and simultaneously the movable block 21 is elastically pushed by the spring 22 to extend out of the first slot way 200 of the sustaining member 20 to be positioned in the recessed hole 11 of the slide base 1. Then the backrest 51 can be pressed down and the slide base 1 together with the slide cover 4 can also be moved downward to one of several positions and temporarily kept stable at that position by means of the sustaining member 20 engaging with one of the engage grooves 301 of the fitting plate 30 as well.

Figure 4:
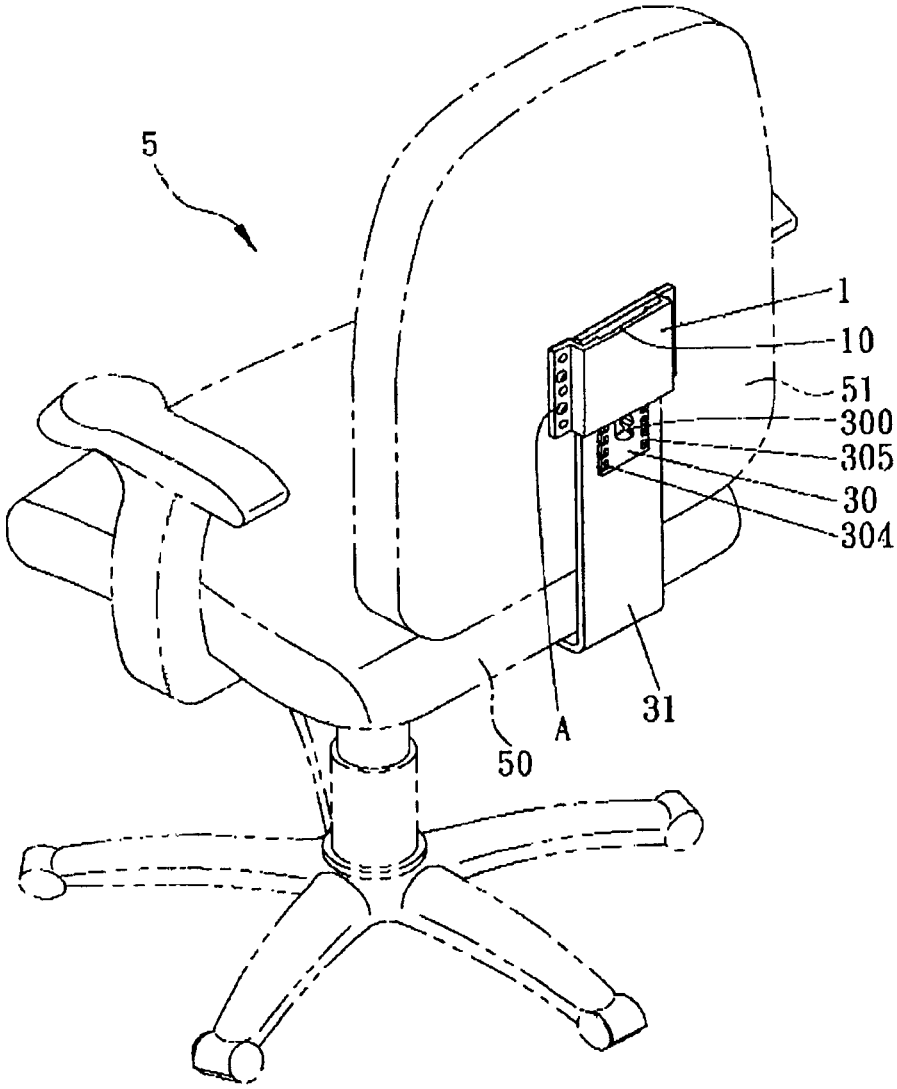
FIG. 4 is a perspective view of the chair backrest elevating device combined with a chair in the present invention.
Figure 5:
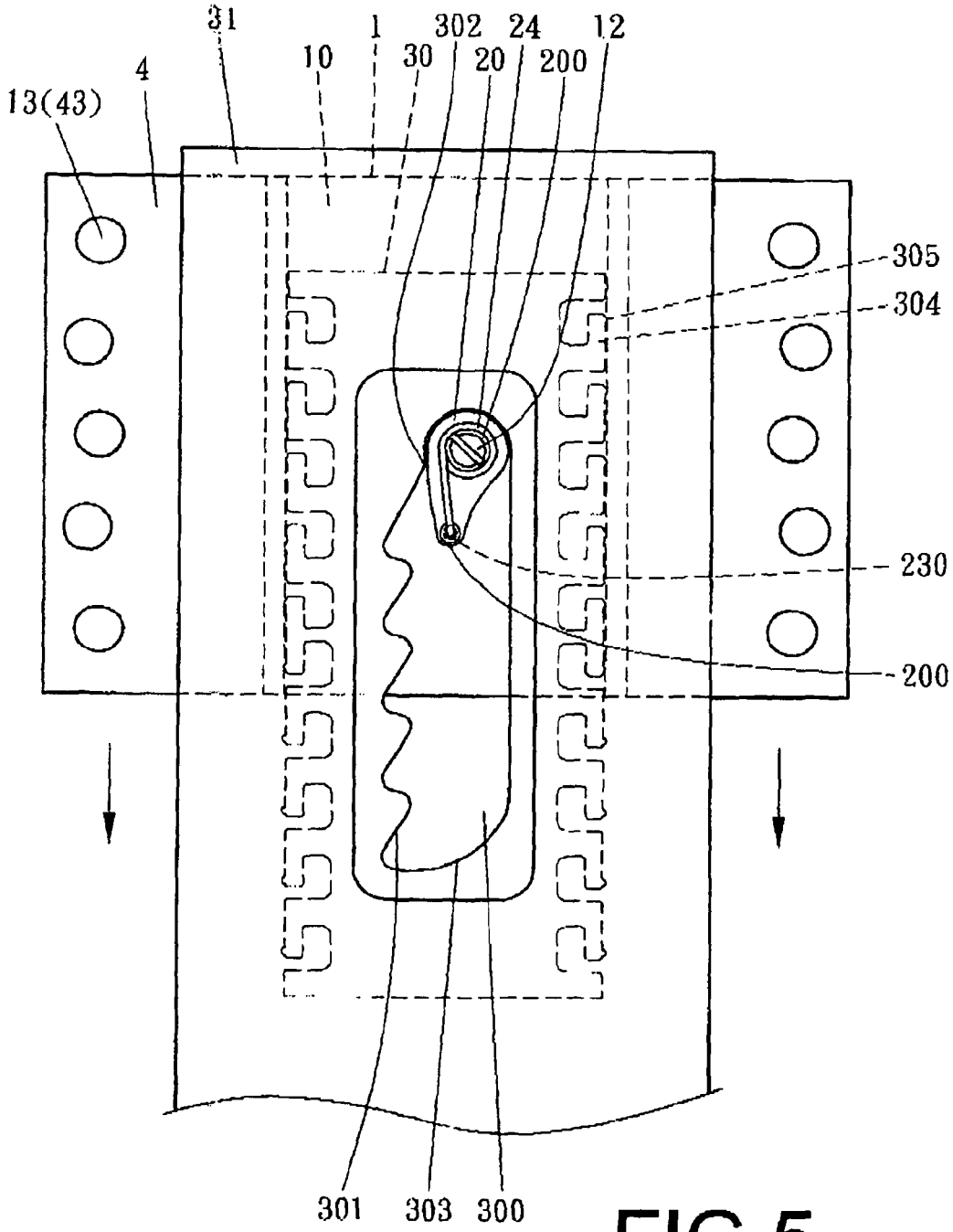
FIG. 5 is a cross-sectional view of the chair backrest elevating device in the present invention, showing that the backrest is adjusted downward.
Figure 6:
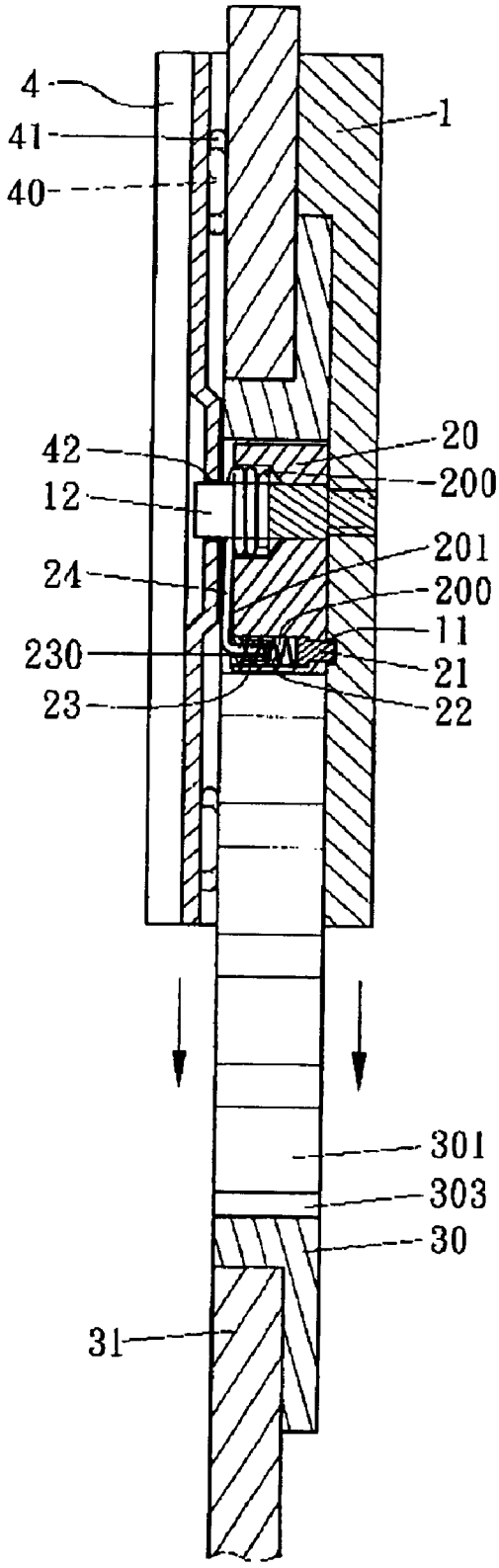
FIG. 6 is a side cross-sectional view of the chair backrest elevating device in a condition of adjusting the backrest downward in the present invention.
Figure 7:
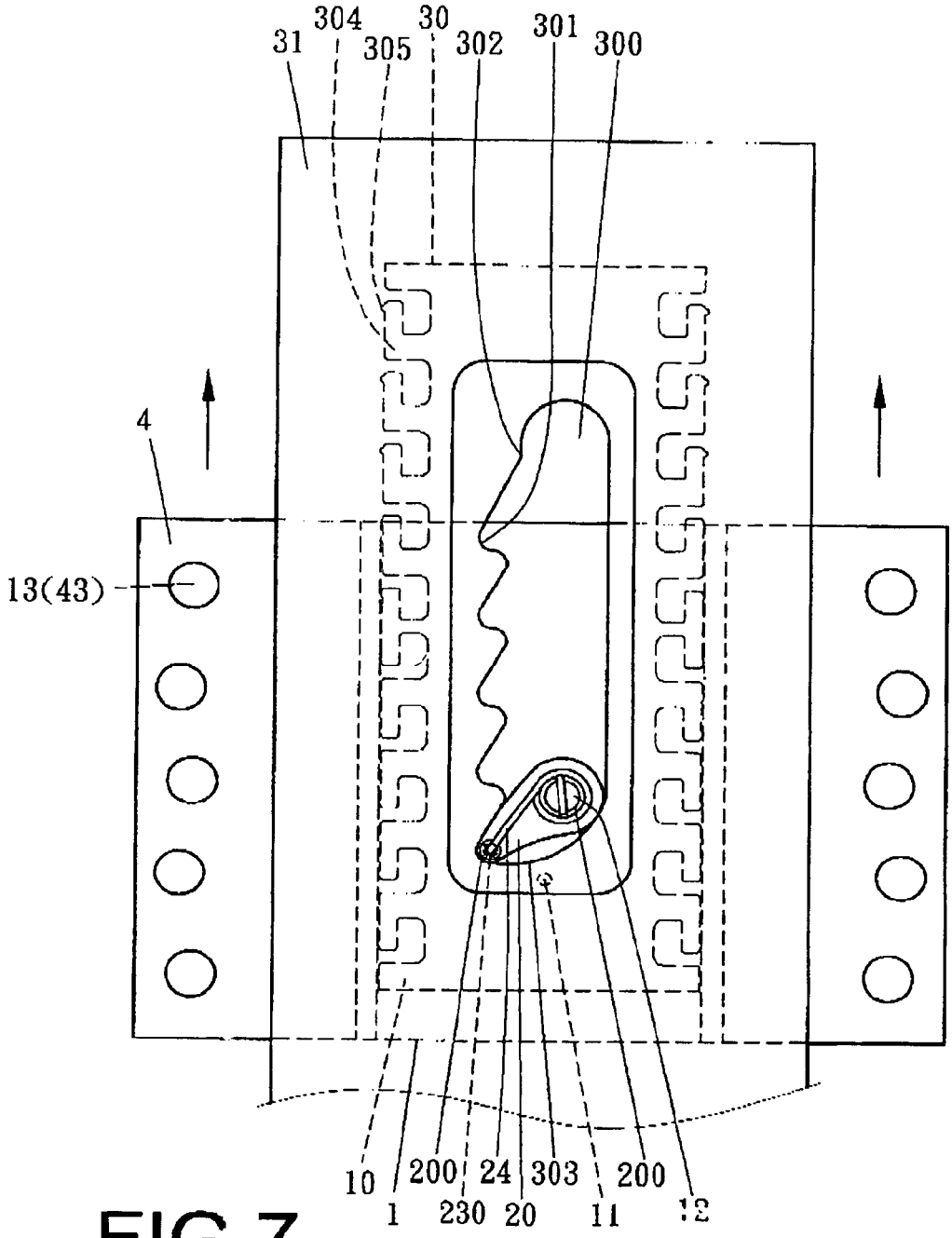
FIG. 7 is a cross-sectional view of the chair backrest elevating device in a condition of adjusting the backrest upward in the present invention.
Figure 8:
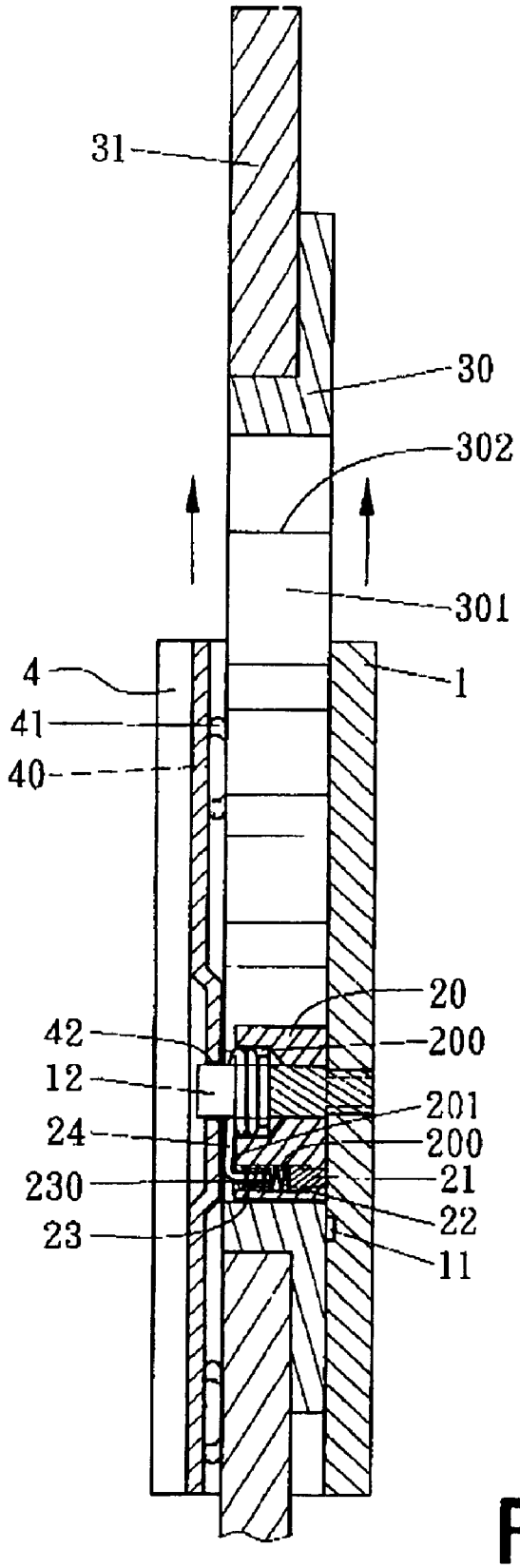
FIG. 8 is a side cross-sectional view of the chair backrest elevating device in a condition of adjusting the backrest upward in the present invention.

To adjust the backrest 51 to move upward, referring to FIGS. 4, 7 and 8, regardless of the position of the backrest 51, at first the backrest 51 has to be pushed downward to the lowest position, and accordingly, the slide base 1 and the slide cover 4 are also to be moved downward to the lowest position, with the sustaining member 20 stopped by the beveling surface 303 of the fitting block 30, and at this time the movable block 21 is actuated to elastically recover its original position and compress the spring 22. Then the backrest 51 becomes able to be pulled and adjusted upward step by step. So the slide base 1 and the slide cover 4 are also moved upward, with the elastic retainer 24 recovering its resilience to actuate the sustaining member 20 to engage with one of the engage grooves 301 of the fitting block 30. Furthermore, when the slide base 1 and the slide cover 4 are moved upward or downward, the resilient bent bars 304 and the projecting edges 305 of the fitting block 30 enable the slide base 1 and the slide cover 4 to be adjusted upward or downward steadily and avoid them being moved bias. In addition, the projections 40 on the slide cover 4, which are respectively fitted thereon with a soft ring 41, can also help the slide base 1 and the slide cover 4 to be moved conveniently and prevent causing looseness.

Thus, after the slide base 1 and the slide cover 4 are assembled with the backrest 51, and the fixing plate unit 3 is combined with the seat 50, with the backrest 51 pulled up or press down, the slide base 1 and the slide cover 4 can be actuated to shift to enable the sustaining member 20 of the adjusting unit 2, which is combined with the positioning rod 12 of the slide base 1, to be correspondingly engaged with and positioned in one of the engage grooves 301 of the fitting block 30, thus attaining effect of adjusting the backrest to move upward or downward to a desired height.

While the preferred embodiment of the invention has been described above, it will be recognized and understood that various modifications may be made therein and the appended claims are intended to cover all such modifications that may fall within the spirit and scope of the invention.

What is claimed is:

1. A chair backrest elevating device comprising:

a slide base formed with a slide way, said slide way provided with a recessed hole and a positioning rod with an opening, said slide base having two opposite sides respectively bored with a plurality of insert holes;

an adjusting unit combined with said positioning rod of said slide base, said adjusting unit composed of a sustaining member, a movable block, a spring, a positioning block and an elastic retainer, said sustaining member disposed with two slot ways and a groove formed between said two slot ways, said movable block and said positioning block orderly received in one of said two slot ways, said spring positioned between said movable block and said positioning block to push and prop them up, said positioning block bored with an insert hole, said elastic retainer positioned in said groove between said two slot ways, said elastic retainer having one end forced in said insert hole of said positioning block and another end resisting against an inner wall of another said slot way;

a fixing plate unit combined with said slide way of said slide base, said fixing plate unit composed of a fitting block and a fixing plate, said fitting block bored with an adjusting opening having one side formed with a plurality of engage grooves vertically, said adjusting opening further having an upper end formed with a stop wall and a lower end provided with a beveling surface, said fitting block having two opposite edges respectively fixed with lots of bent bars respectively formed with a projecting edge, said fixing plate having an upright portion provided with a fitting opening and a flat portion bored with plural insert holes; and a slide cover covering both said adjusting unit and said fixing plate unit and assembled with said insert holes of said slide base, said slide cover provided with plural projections respectively fitted thereon with a soft ring, said slide cover bored with a positioning hole in the center, said slide cover further disposed with plural insert holes at two opposite sides and a threaded hole between every two said insert holes.

2. The chair backrest elevating device as claimed in claim 1, wherein said positioning rod has a lower portion formed into a polygon and an upper portion is shaped as a round rod.

* * * * *